US011125505B2

(12) United States Patent
Lee et al.

(10) Patent No.: US 11,125,505 B2
(45) Date of Patent: Sep. 21, 2021

(54) HEAT EXCHANGER AND AIR CONDITIONER INCLUDING THE SAME

(71) Applicant: Samsung Electronics Co., Ltd., Suwon-si (KR)

(72) Inventors: Sang Mu Lee, Kanagawa (JP); Akihiro Fujiwara, Kanagawa (JP); Hyun Young Kim, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/649,115

(22) PCT Filed: Sep. 14, 2018

(86) PCT No.: PCT/KR2018/010871
§ 371 (c)(1),
(2) Date: Mar. 19, 2020

(87) PCT Pub. No.: WO2019/059595
PCT Pub. Date: Mar. 28, 2019

(65) Prior Publication Data

US 2020/0292237 A1 Sep. 17, 2020

(30) Foreign Application Priority Data

Sep. 19, 2017 (JP) ..... JP2017-179125

(51) Int. Cl.
*F28D 1/04* (2006.01)
*F28D 1/02* (2006.01)
(Continued)

(52) U.S. Cl.
CPC ..... *F28D 1/024* (2013.01); *F25B 39/00* (2013.01); *F28D 1/0475* (2013.01); *F28F 1/32* (2013.01); *F28F 1/40* (2013.01)

(58) Field of Classification Search
CPC ..... F28D 1/024; F28D 1/0475; F25B 39/00; F28F 1/32; F28F 1/40
(Continued)

(56) References Cited

U.S. PATENT DOCUMENTS 6,067,712 A * 5/2000 Randlett ..... B21J 5/068 29/890.053
9,879,921 B2 1/2018 Lee et al.
(Continued)

FOREIGN PATENT DOCUMENTS

EP 2778593 A1 9/2014
JP S55-45545 A 3/1980
(Continued)

OTHER PUBLICATIONS

International Search Report dated Jan. 15, 2019 in connection with International Patent Application No. PCT/KR2018/010871, 2 pages.
(Continued)

*Primary Examiner* — Davis D Hwu

(57) ABSTRACT

The present disclosure relates to a heat exchanger and an air conditioner improving heat exchange ability by optimizing the number of high protrusions of a heat transfer tube and a height difference between the high protrusion and a low protrusion to increase the heat transfer performance of the heat transfer tube or reduce the pressure loss in the tube. An air conditioner includes the heat exchanger including a heat transfer tube configured to allow the refrigerant to flow, fins installed on the heat transfer tube, and fin collars forming an insertion hole through which the heat transfer tube is inserted and passes, and the fin collars is in contact with the heat transfer tube by tube expansion of the heat transfer tube. The heat transfer tube includes high protrusions disposed in a spiral shape with respect to a tube axis direction of the heat transfer tube, twenty one to twenty seven of the high protrusions being formed along a circumferential direction
(Continued)

of the heat transfer tube, and low protrusions disposed between two of the adjacent high protrusions along the circumferential direction of the heat transfer tube and having a height lower by 0.03 mm to 0.05 mm than the high protrusions.

15 Claims, 14 Drawing Sheets

(51) Int. Cl.
*F25B 39/00* (2006.01)
*F28D 1/047* (2006.01)
*F28F 1/32* (2006.01)
*F28F 1/40* (2006.01)

(58) Field of Classification Search
USPC ..... 165/151
See application file for complete search history.

(56) References Cited

U.S. PATENT DOCUMENTS

2009/0133864 A1* 5/2009 Stier ..... F28F 1/40 165/183
2009/0242184 A1* 10/2009 Mishima ..... F28F 1/36 165/181
2010/0116461 A1* 5/2010 Saito ..... F24F 13/222 165/62
2011/0113820 A1 5/2011 Lee et al.
2013/0283843 A1* 10/2013 Takenaka ..... F25B 13/00 62/324.6

FOREIGN PATENT DOCUMENTS

| | | | |
|---|---|---|---|
| JP | 09-229574 | A | 9/1997 |
| JP | 2005-257160 | A | 9/2005 |
| JP | 2009-250562 | A | 10/2009 |
| JP | 2010-038502 | A | 2/2010 |
| JP | 6177195 | B2 | 8/2017 |
| WO | 2013/046482 | A1 | 3/2015 |
| WO | 2013/069299 | A1 | 4/2015 |

OTHER PUBLICATIONS

Written Opinion of the International Searching Authority dated Jan. 15, 2019 in connection with International Patent Application No. PCT/KR2018/010871, 10 pages.
Office Action dated Aug. 3, 2021 in connection with Japanese Patent Application No. 2017-179125, 9 pages.

* cited by examiner

FIG. 7

| | OUTER DIAMETER | DIFFERENCE BETWEEN RADIUS AT HIGH PROTRUSION AND RADIUS AT LOW PROTRUSION (R2-R1) | NUMBER OF HIGH PROTRUSIONS (N) | HEIGHT OF HIGH PROTRUSION | HEIGHT OF LOW PROTRUSION | IMPROVEMENT RATE OF HEAT EXCHANGE ABILITY |
|---|---|---|---|---|---|---|
| | mm | mm | - | mm | mm | % |
| EXAMPLE 1 | 4 | 0.05 | 21 | 0.15 | 0.1 | 101 |
| EXAMPLE 2 | 6 | 0.04 | 24 | 0.19 | 0.15 | 100.8 |
| EXAMPLE 3 | 8 | 0.03 | 27 | 0.23 | 0.2 | 100.3 |
| COMPARATIVE EXAMPLE | 9.52 | 0.02 | 30 | 0.27 | 0.25 | 99.5 |

HEAT EXCHANGER AND AIR CONDITIONER INCLUDING THE SAME

CROSS-REFERENCE TO RELATED APPLICATIONS

This application is a 371 of International Application No. PCT/KR2018/010871 filed on Sep. 14, 2018, which claims priority to Japanese Patent Application No. 2017-179125 filed on Sep. 19, 2017, the disclosures of which are herein incorporated by reference in their entirety.

BACKGROUND

1. Field

The present disclosure relates to a heat exchanger and an air conditioner including the same.

2. Description of Related Art

There are known heat transfer tubes with inner grooves (see Patent Document 1, for example) in which a plurality of high fins (sixteen high fins in an embodiment) is arranged in a tube circumferential direction in a tube axis orthogonal cross section, three to five low fins are arranged between the respective high fins, a height of the high fin is 0.14 to 0.20 mm, a vertex angle of the high fin is 10 to 20 degrees, a height of the low fin is 0.10 to 0.14 mm, a vertex angle of the low fin is 10 to 15 degrees, a difference in height between the high fin and the low fin is 0.04 mm or more and 0.06 mm or less, lead angles of the high fin and low fin are equal to each other and are in the range between 20 and 40 degrees, and also top portions of the high fin and low fin are curved surfaces with a radius of curvature in the tube axis orthogonal cross section, the radius of curvature of the top portion of the high fin is 0.03 to 0.06 mm, and the radius of curvature of the top portion of the low fin is 0.03 to 0.04 mm.

Also, there are known heat transfer tubes with inner grooves (see Patent Document 2, for example) in which high fins are formed by twenty-four band-shaped protrusion members having a substantially trapezoidal cross section, low fins are each disposed between two of the high fins adjacent to each other and are provided in the same number as the high fins, a fin height ratio Hf1/Hf2 between a height Hf1 of the high fin and a height Hf2 of the low fin is set to 1.15 or less before tube expanding, and a fin height difference Hf1−Hf2 between the height Hf1 of the high fin and the height Hf2 of the low fin is set to 0.02 mm or less.

Patent Document 1: Japanese Patent Publication No. 2010-133668

Patent Document 2: Japanese Patent Publication No. 2012-002453

In the case of applying a configuration in which, for example, sixteen high protrusions are formed in a tube circumferential direction of a heat transfer tube or applying a configuration in which low protrusions lower than high protrusions, for example as low as 0.02 mm or less, are formed between the adjacent high protrusions in the tube circumferential direction of the heat transfer tube, it may be difficult to increase the heat transfer performance of the heat transfer tube or reduce the pressure loss in the tube by optimizing both the number of high protrusions of the heat transfer tube and the height difference between the high protrusion and low protrusion.

SUMMARY

The present disclosure is directed to providing a heat exchanger improving heat exchange ability by optimizing the number of high protrusions of a heat transfer tube and a height difference between the high protrusion and a low protrusion to increase the heat transfer performance of the heat transfer tube or reduce the pressure loss in the tube.

One aspect of the present disclosure provides an air conditioner including a pipe configured to allow a refrigerant to flow, an outdoor unit comprising an outdoor heat exchanger configured to heat exchange the refrigerant moving along the pipe with outdoor air, and an indoor unit comprising an indoor heat exchanger configured to heat exchange the refrigerant moving along the pipe with indoor air, wherein at least one of the outdoor heat exchanger and the indoor heat exchanger includes a heat transfer tube configured to allow the refrigerant to flow, fins installed on the heat transfer tube; and fin collars forming an insertion hole through which the heat transfer tube is inserted and passes, the fin collars being in contact with the heat transfer tube by tube expansion of the heat transfer tube.

The heat transfer tube may include high protrusions disposed in a spiral shape with respect to a tube axis direction of the heat transfer tube, twenty one to twenty seven of the high protrusions being formed along a circumferential direction of the heat transfer tube, and low protrusions disposed between two of the adjacent high protrusions along the circumferential direction of the heat transfer tube and having a height lower by 0.03 mm to 0.05 mm than the high protrusions.

A width of a top portion of the high protrusion may be larger than a width of a top portion of the low protrusion.

Two or three of the low protrusions may be formed between two of the adjacent high protrusions along the circumferential direction of the heat transfer tube.

A height of the low protrusion may be in the range of 0.1 mm to 0.2 mm.

The high protrusion may be formed such that a vertex angle thereof is in the range of 15 degrees to 30 degrees.

The low protrusion may be formed such that a vertex angle thereof is in the range of 10 degrees to 15 degrees.

The high protrusion may be formed such that the shape of a top portion thereof is substantially trapezoidal.

The low protrusion may be formed such that the shape of a top portion thereof is substantially circular.

Another aspect of the present disclosure provides a heat exchanger including a heat transfer tube configured to allow a refrigerant to flow, fins installed on the heat transfer tube to widen a heat transfer area of the heat transfer tube, and fin collars forming an insertion hole through which the heat transfer tube is inserted and passes, the fin collars being in contact with the heat transfer tube by tube expansion of the heat transfer tube.

The heat transfer tube may include high protrusions disposed in a spiral shape with respect to a tube axis direction of the heat transfer tube, twenty one to twenty seven of the high protrusions being formed along a circumferential direction of the heat transfer tube, and low protrusions disposed between two of the adjacent high protrusions along the circumferential direction of the heat transfer tube and having a height lower by 0.03 mm to 0.05 mm than the high protrusions.

A width of a top portion of the high protrusion may be larger than a width of a top portion of the low protrusion.

Two or three of the low protrusions may be formed between two of the adjacent high protrusions along the circumferential direction of the heat transfer tube.

A height of the low protrusion may be in the range of 0.1 mm to 0.2 mm.

The high protrusion may be formed such that a vertex angle thereof is in the range of 15 degrees to 30 degrees.

The low protrusion may be formed such that a vertex angle thereof is in the range of 10 degrees to 15 degrees.

The high protrusion may be formed such that the shape of a top portion thereof is substantially trapezoidal, and the low protrusion may be formed such that the shape of a top portion thereof is substantially circular.

The present disclosure can provide a heat exchanger improving heat exchange ability by optimizing the number of high protrusions of a heat transfer tube and a height difference between the high protrusion and a low protrusion to increase the heat transfer performance of the heat transfer tube or reduce the pressure loss in the tube.

BRIEF DESCRIPTION OF THE DRAWINGS

FIG. 7 is a table illustrating the relationship between an outer diameter of the heat transfer tube, the number of high protrusions, the difference between the radius at the high protrusion side and the radius at the low protrusion side on the inner circumferential circle of the heat transfer tube, and the improvement rate of the heat exchange ability of the heat exchanger, for three examples and one comparative example.

DETAILED DESCRIPTION

Configuration of Air Conditioner in an Embodiment of the Present Disclosure

Figure 1:
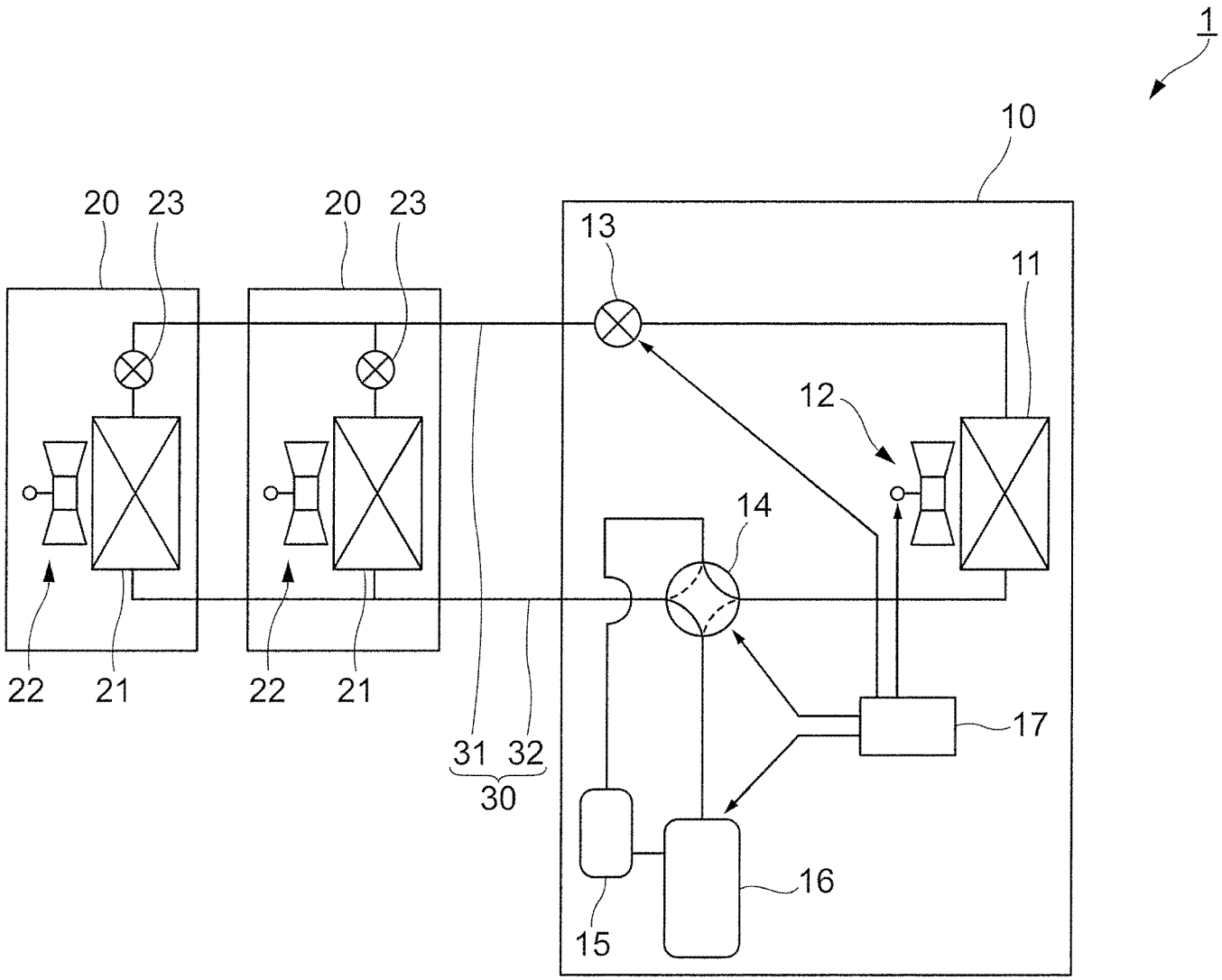
FIG. 1 is a schematic configuration diagram of an air conditioner in an embodiment of the present disclosure.

FIG. 1 is a schematic configuration diagram of an air conditioner 1 in an embodiment of the present disclosure. The air conditioner 1 includes an outdoor unit 10 installed outside a building as an example, a plurality of indoor units 20 installed in each room of the building as an example, and a pipe 30 connected to the outdoor unit 10 and the indoor unit 20 to allow a refrigerant circulating through the outdoor unit 10 and the indoor unit 20 to flow. Although FIG. 1 illustrates that two of the indoor units 20 are connected to one of the outdoor unit 10, one of the indoor unit 20 or three or more of the indoor units 20 may be connected to one of the outdoor unit 10.

The outdoor unit 10 includes an outdoor heat exchanger 11 which is a device for transferring heat from a high temperature object to a low temperature object, an outdoor blower 12 configured to promote heat exchange between the refrigerant and air by contacting the air with the outdoor heat exchanger 11, and an outdoor expansion valve 13 configured to expand and vaporize condensed liquid refrigerant to low pressure and low temperature. The outdoor unit 10 further includes a four-way switching valve 14 configured to change a flow direction of the refrigerant, an accumulator 15 configured to separate the liquid refrigerant not evaporated, and a compressor 16 configured to compress the refrigerant. The four-way switching valve 14 is connected to the outdoor heat exchanger 11, the accumulator 15, and the compressor 16 through piping. The outdoor heat exchanger 11 and the outdoor expansion valve 13 are connected through piping, and the accumulator 15 and the compressor 16 are connected through piping. FIG. 1 illustrates a case where a heating operation is performed as a changed connection state of the four-way switching valve 14.

The outdoor unit 10 further includes a controller 17 configured to control operations of the outdoor blower 12, the outdoor expansion valve 13, the compressor 16 and the like, and switching of the four-way switching valve 14 and the like. The controller 17 may be realized by, for example, a microcomputer.

The indoor unit 20 includes an indoor heat exchanger 21 which is a device for transferring heat from a high temperature object to a low temperature object, an indoor blower 22 configured to promote heat exchange between the refrigerant and air by contacting the air with the indoor heat exchanger 21, and an indoor expansion valve 23 configured to expand and vaporize condensed liquid refrigerant to low pressure and low temperature.

The pipe 30 includes a liquid refrigerant pipe 31 through which liquid refrigerant flows, and a gas refrigerant pipe 32 through which gas refrigerant flows. The liquid refrigerant pipe 31 is disposed such that the refrigerant flows between the indoor expansion valve 23 of the indoor unit 20 and the outdoor expansion valve 13 of the outdoor unit 10. The gas refrigerant pipe 32 is disposed such that the refrigerant passes between the four-way switching valve 14 of the outdoor unit 10 and a gas side of the indoor heat exchanger 21 of the indoor unit 20.

[Configuration of Heat Exchanger in an Embodiment of the Present Disclosure]

Figure 2:
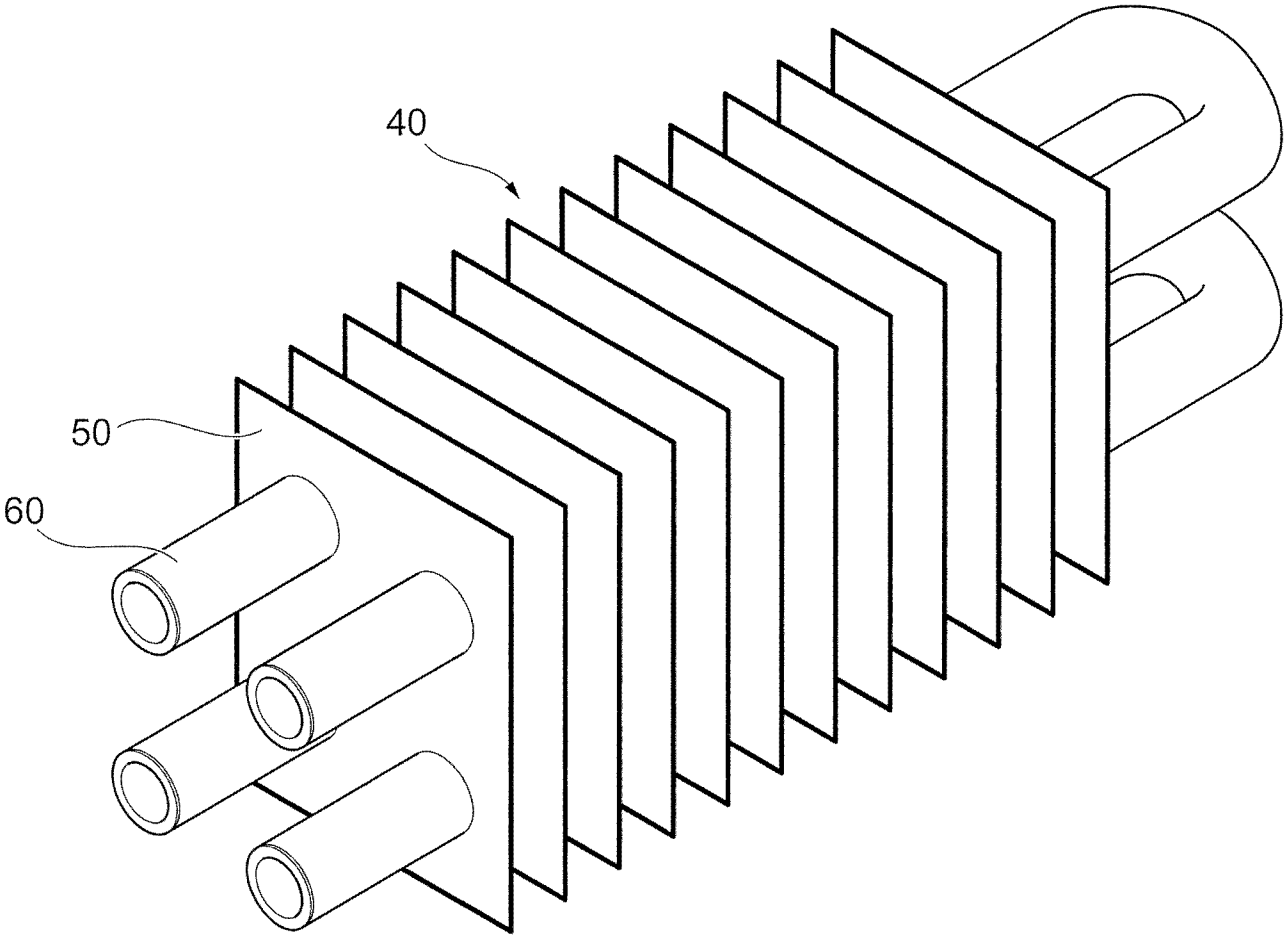
FIG. 2 is a perspective view of a heat exchanger in an embodiment of the present disclosure.

FIG. 2 is a perspective view of a heat exchanger 40 in an embodiment of the present disclosure. The heat exchanger 40 corresponds to at least one of the outdoor heat exchanger 11 and the indoor heat exchanger 21 illustrated in FIG. 1. As illustrated in the figure, the heat exchanger 40 is a fin tube type heat exchanger and includes a plurality of fins 50 and heat transfer tubes 60 for heat exchange.

The plurality of fins 50 are arranged by a predetermined interval to be orthogonal to the plurality of heat transfer tubes 60. The plurality of heat transfer tubes 60 is installed in parallel to be inserted into and penetrate the insertion holes of the fins 50. The heat transfer tubes 60 become a part of the piping 30 in the air conditioner 1 of FIG. 1, and the refrigerant flows through the inside thereof. One of HC single refrigerant, a mixed refrigerant containing HC, R32, R410A, R407C, and carbon dioxide may be used as the refrigerant. Because heat is transferred through the fins 50, a heat transfer area that becomes a contact surface with air may be expanded, and heat exchange between the refrigerant flowing inside the heat transfer tubes 60 and the air flowing outside thereof may be efficiently performed.

Figure 3:
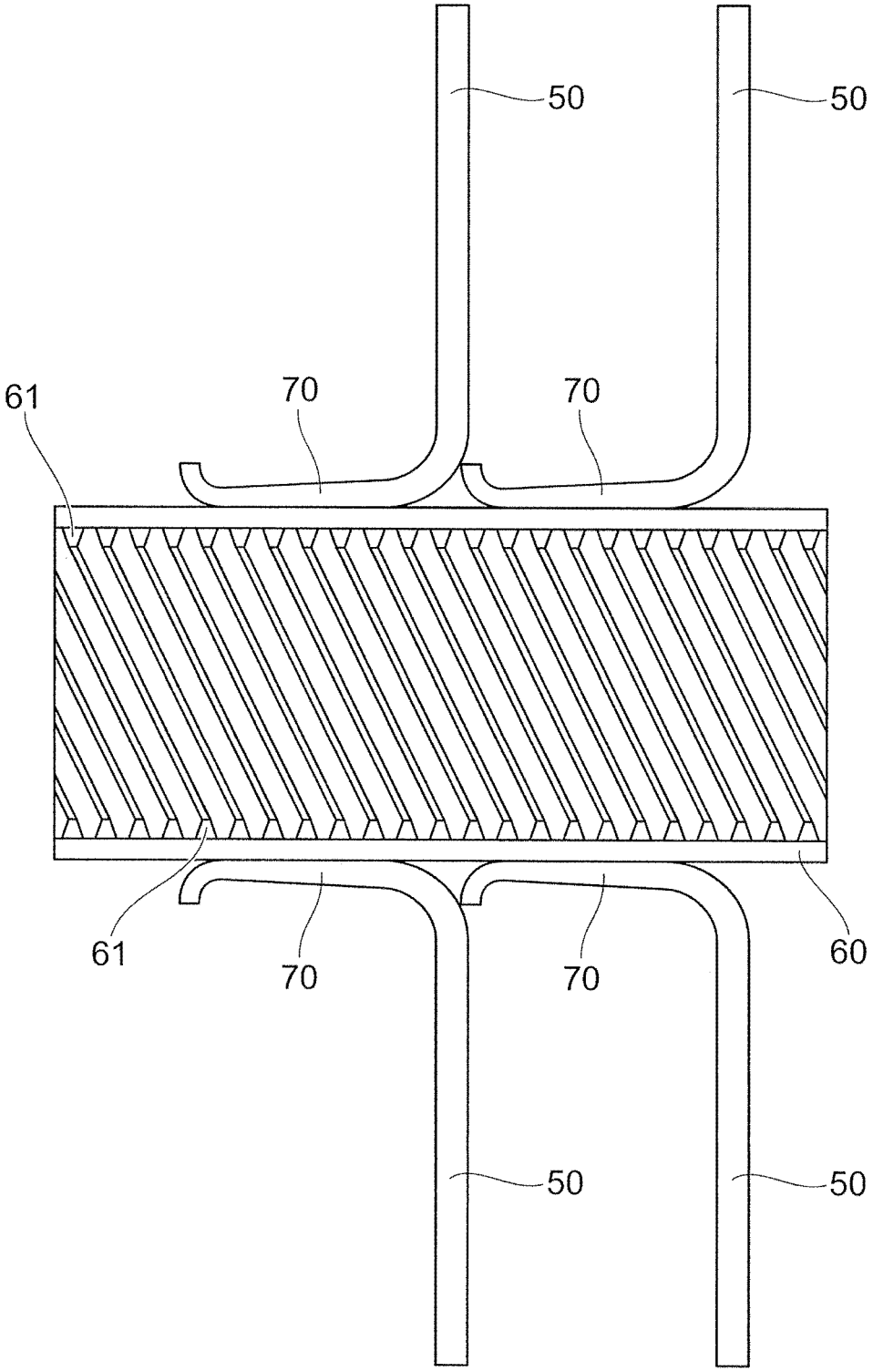
FIG. 3 is a cross-sectional view of a contact portion between fins and a heat transfer tube of the heat exchanger in an embodiment of the present disclosure.

FIG. 3 is a cross-sectional view of a contact portion between the fins 50 and the heat transfer tube 60 of the heat exchanger 40 in an embodiment of the present disclosure. As illustrated in the figure, a fin collar 70 is connected to the fin 50. That is, the heat exchanger 40 is a fin tube type heat exchanger made by contacting the heat transfer tubes 60 with the fin collar 70 of the fins 50 provided at a portion through which the heat transfer tubes 60 are inserted and passed by expanding the tubes through an expander. Protrusions 61 are formed along a longitudinal direction of the heat transfer tube 60. The figure illustrates that double lines run from the protrusions 61 on an upper side of an inner circumferential surface of the heat transfer tube 60 to the corresponding protrusions 61 on a lower side of the inner circumferential surface along the inner circumferential surface. That is, the protrusions 61 are formed in the heat transfer tube 60 in a spiral shape with respect to a tube axis direction.

First Embodiment

Figure 4:
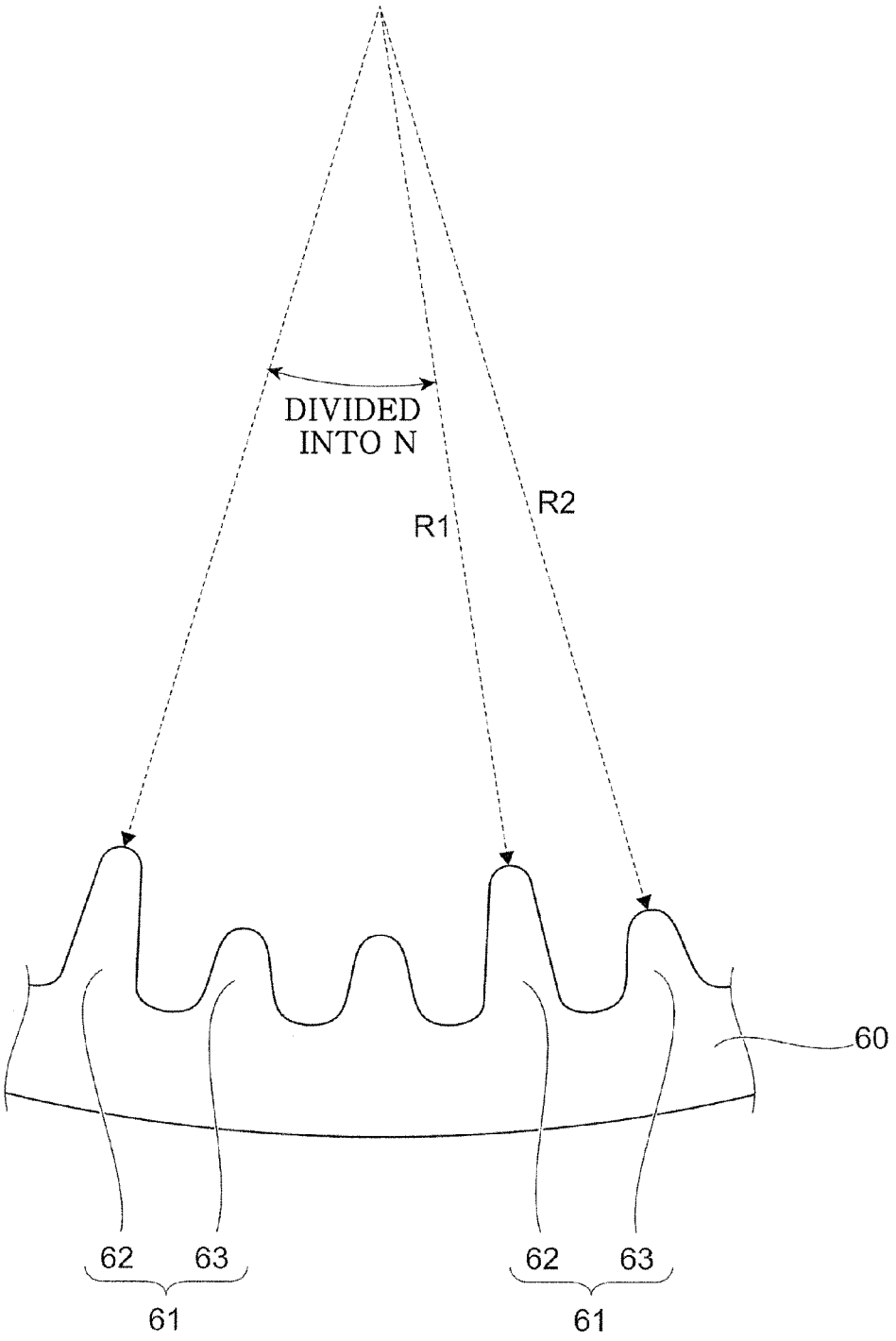
FIG. 4 is a partial cross-sectional view of a heat transfer tube of the heat exchanger for explaining a first embodiment of the present disclosure.

FIG. 4 is a partial cross-sectional view of the heat transfer tube 60 of the heat exchanger 40 for explaining a first embodiment of the present disclosure. As illustrated in the figure, the heat transfer tube 60 is provided with the protrusions 61 along a circle (hereinafter referred to as an "inner circumferential circle") formed by cutting the inner circumferential surface of the heat transfer pipe in a plane perpendicular to the tube axis direction, and the protrusion 61 includes a high protrusion 62 and a low protrusion 63. That is, the heat transfer tube 60 is provided with the high protrusions 62 and the low protrusions 63 formed in a spiral shape with respect to the tube axis direction. Hereinafter, the number of the high protrusions 62 in a circumferential direction of the inner circumferential circle of the heat transfer tube 60 will be denoted by N. In addition, a radius at the high protrusion 62 side of the inner circumferential circle of the heat transfer tube 60 is denoted by R1, and a radius at the low protrusion 63 side of the inner circumferential circle of the heat transfer tube 60 is denoted by R2.

When the number N of the high protrusions 62 is too small in the tube circumferential direction of the inner circumferential circle of the heat transfer tube 60, the top portion is greatly deformed by the contact with the expander at the time of tube expansion, so that the contact heat resistance between the heat transfer tube 60 and the fin collar 70 of the fins 50 increases and the heat transfer performance of the heat transfer tube 60 decreases, thereby lowering the heat exchange ability of the heat exchanger 40. On the other hand, when the number N of the high protrusions 62 is too large in the tube circumferential direction of the inner circumferential circle of the heat transfer tube 60, the heat transfer tube 60 becomes closer to a circle than a polygon at the time of tube expansion and thus a force to return to the state prior to the tube expansion increases, so that the contact heat resistance between the heat transfer tube 60 and the fin collar 70 of the fins 50 increases and the heat transfer performance of the heat transfer tube 60 decreases, thereby lowering the heat exchange ability of the heat exchanger 40. Therefore, in the first embodiment, the high protrusions 62 are formed on the inner circumferential circle of the heat transfer tube 60 such that the number N thereof becomes a value within a predetermined range. In this case, the high protrusions 62 are arranged at equal intervals in the tube circumferential direction on the inner circumferential circle of the heat transfer tube 60 so that the heat transfer tube 60 is evenly expanded. The "equal intervals" do not mean that the entire intervals are exactly the same, and the intervals may be slightly different as long as the heat transfer tube 60 may be evenly expanded. Thus, the high protrusions 62 only need to be disposed at substantially equal intervals in the tube circumferential direction on the inner circumferential circle of the heat transfer tube 60.

When the difference R2−R1 between the radius R1 at the high protrusion 62 side on the inner circumferential circle of the heat transfer tube 60 and the radius R2 at the low protrusion 63 side on the inner circumferential circle of the heat transfer tube 60 is too small, the top portion of the low protrusion 63 is also deformed by the contact with the expander at the time of tube expansion so that the heat transfer performance of the heat transfer tube 60 decreases. On the other hand, when the difference R2−R1 between the radius R1 at the high protrusion 62 side on the inner circumferential circle of the heat transfer tube 60 and the radius R2 at the low protrusion 63 side on the inner circumferential circle of the heat transfer tube 60 is too large, it becomes as follows. That is, when the high protrusion 62 becomes too high, the amount of the refrigerant colliding with the high protrusion 62 increases, so that the pressure loss in the tube of the heat transfer tube 60 increases, thereby lowering the heat exchange ability of the heat exchanger 40. In addition, when the low protrusion 63 becomes too low, as a surface area of the inner surface of the heat transfer tube 60 becomes small, the heat transfer performance of the heat transfer tube 60 is lowered, thereby lowering the heat exchange ability of the heat exchanger 40. Therefore, in the first embodiment, the low protrusions 63 are formed between the high protrusions 62 in the tube circumferential direction on the inner circumferential circle of the heat transfer tube 60, and the difference R2−R1 between the radius R1 at the high protrusion 62 side on the inner circumferential circle of the heat transfer tube 60 and the radius R2 at the low protrusion 63 side on the inner circumferential circle of the heat transfer tube 60 is set to a value within a predetermined range.

Because the top portion of the high protrusion 62 is easily deformed by the contact with the expander, it is appropriate that the high protrusion 62 and the low protrusion 63 are formed such that a width of the top portion of the high protrusion 62 is larger than a width of the top portion of the low protrusion 63.

Figure 5:
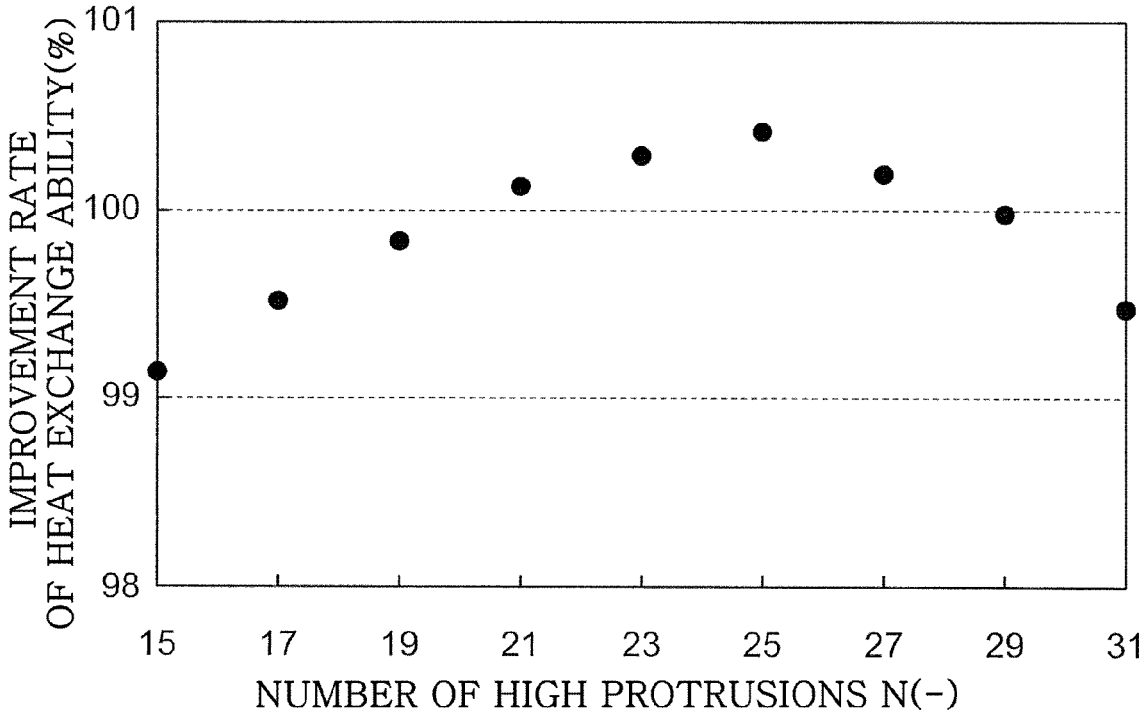
FIG. 5 is a graph illustrating the relationship between the number of high protrusions on an inner circumferential circle of the heat transfer tube and an improvement rate of the heat exchange ability of the heat exchanger.

FIG. 5 is a graph illustrating the relationship between the number N of the high protrusions 62 on an inner circumferential circle of the heat transfer tube 60 and an improvement rate of the heat exchange ability of the heat exchanger 40. In this graph, the heat exchange ability of the heat exchanger 40 having a general specification is indicated as 100%. As illustrated in the graph, in the range where the number N of the high protrusions 62 is twenty one or more and twenty seven or less, a heat exchange ability improvement rate exceeds 100%. Therefore, it is appropriate that the number N of the high protrusions 62 is a value within the range between twenty one or more and twenty seven or less.

Figure 6:
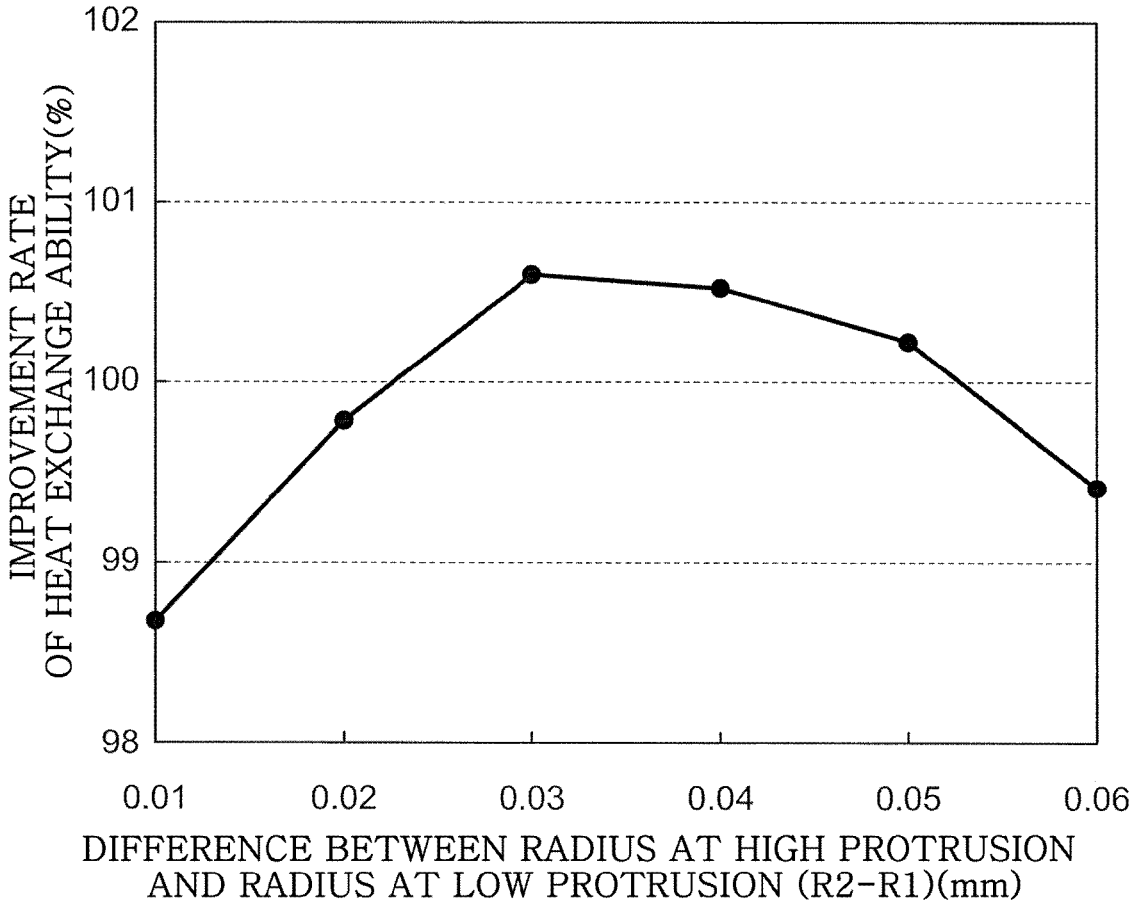
FIG. 6 is a graph illustrating the relationship between a difference between a radius at a high protrusion side and a radius at a low protrusion side on the inner circumferential circle of the heat transfer tube and the improvement rate of the heat exchange ability of the heat exchanger.

FIG. 6 is a graph illustrating the relationship between the difference R2−R1 between the radius at the high protrusion 62 side and the radius at the low protrusion 63 side on the inner circumferential circle of the heat transfer tube 60 and the improvement rate of the heat exchange ability of the heat exchanger 40. Also in this graph, the heat exchange ability of the heat exchanger 40 having a general specification is indicated as 100%. As illustrated in the graph, in the range where the difference R2−R1 in the radii is 0.03 mm or more and 0.05 mm or less, the heat exchange ability improvement rate exceeds 100%. Therefore, it is appropriate that the difference R2−R1 between the radius R1 at the high protrusion 62 side and the radius R2 at the low protrusion 63 side on the inner circumferential circle of the heat transfer tube 60 is in the range of 0.03 mm or more and 0.05 mm or less.

As such, in the first embodiment, the high protrusions 62 on the inner circumferential circle of the heat transfer tube 60 are formed at portions on the inner circumferential circle which are substantially evenly divided into twenty one to twenty seven. Accordingly, the contact heat resistance between the heat transfer tube 60 and the fin collar 70 of the fins 50 decreases and the heat transfer performance of the heat transfer tube 60 increases, so that the heat exchange ability of the heat exchanger 40 is improved. In the case where the high protrusions 62 are formed at portions substantially evenly divided on the inner circumferential circle of the heat transfer tube 60, for example, the portions of twenty divided on the inner circumferential circle, the contact heat resistance between the heat transfer tube 60 and the fin collar 70 of the fins 50 increases and the heat transfer performance of the heat transfer tube 60 decreases, so that the heat exchange ability of the heat exchanger 40 is lowered. On the other hand, in the case where the high protrusions 62 are formed at portions substantially evenly divided on the inner circumferential circle of the heat transfer tube 60, for example, at the portions of twenty eight divided on the inner circumferential circle, the contact heat resistance between the heat transfer tube 60 and the fin collar 70 of the fins 50 increases and the heat transfer performance of the heat transfer tube 60 decreases, so that the heat exchange ability of the heat exchanger 40 is lowered.

In the first embodiment, the lower protrusions 63 are formed between the high protrusions 62 in the inner circumferential circle direction of the heat transfer tube 60, and the difference R2−R1 between the radius at the high protrusion 62 side and the radius at the low protrusion 63 side on the inner circumferential circle of the heat transfer tube 60 is set in the range of 0.03 mm to 0.05 mm. Accordingly, the heat transfer performance of the heat transfer tube 60 increases, or the pressure loss in the tube of the heat transfer tube 60 decreases, thereby improving the heat exchange ability of the heat exchanger 40. When the difference R2−R1 between the radius at the high protrusion 62 side and the radius at the low protrusion 63 side on the inner circumferential circle of the heat transfer tube 60 is set to 0.02 mm or less, the top portion of the lower protrusion 63 is deformed by the contact with the expander, thereby lowering the heat transfer performance of the heat transfer tube 60. On the other hand, when the difference R2−R1 between the radius at the high protrusion 62 side and the radius at the low protrusion 63 side on the inner circumferential circle of the heat transfer tube 60 is set to 0.06 mm or more, which is in the case where the high protrusion 62 becomes 0.06 mm or more higher than conventionally, the pressure loss in the tube of the heat transfer tube 60 increases, thereby lowering the heat exchange ability of the heat exchanger 40. When the difference R2−R1 between the radius at the high protrusion 62 side and the radius at the low protrusion 63 side on the inner circumferential circle of the heat transfer tube 60 is set to 0.06 mm or more, which is in the case where the low protrusion 63 becomes 0.06 mm or more lower than conventionally, the heat transfer performance of the heat transfer tube 60 is lowered, thereby lowering the heat exchange ability of the heat exchanger 40.

FIG. 7 is a table illustrating the relationship between an outer diameter of the heat transfer tube 60, the number of the high protrusions 62, the difference between the radius at the high protrusion 62 side and the radius at the low protrusion 63 side on the inner circumferential circle of the heat transfer tube 60, and the improvement rate of the heat exchange ability of the heat exchanger 40, for three examples and one comparative example.

Example 1 is a case where the outer diameter of the heat transfer tube 60 is 4 mm. In this case, the number of the high protrusions 62 is set to twenty one. Because the deformation of the top portion of the high protrusions 62 is large when the number of the high protrusions 62 is small, the difference between the radius at the high protrusion 62 side and the radius at the low protrusion 63 side on the inner circumferential circle of the heat transfer tube 60 is set to 0.05 mm.

Example 2 is a case where the outer diameter of the heat transfer tube 60 is 6 mm. In this case, the number of the high protrusions 62 is set to twenty four. The difference between the radius at the high protrusion 62 side and the radius at the low protrusion 63 side on the inner circumferential circle of the heat transfer tube 60 is set to 0.04 mm.

Example 3 is a case where the outer diameter of the heat transfer tube 60 is 8 mm. In this case, the number of the high protrusions 62 is set to twenty seven. Because the deformation of the top portion of the high protrusions 62 is small when the number of the high protrusions 62 is large, the difference between the radius at the high protrusion 62 side and the radius at the low protrusion 63 side on the inner circumferential circle of the heat transfer tube 60 is set to 0.03 mm.

On the other hand, the comparative example is a case where the outer diameter of the heat transfer tube 60 is 9.52 mm. In this case, the number of the high protrusions 62 is set to thirty, and the difference between the radius at the high protrusion 62 side and the radius at the low protrusion 63 side on the inner circumferential circle of the heat transfer tube 60 is set to 0.02 mm.

As illustrated in the graph, when the outer diameter is 4 mm to 8 mm compared to the case where the outer diameter is 9.52 mm, the contact heat resistance between the heat transfer tube 60 and the fin collar 70 of the fins 50 decreases and the heat transfer performance of the heat transfer tube 60 increases, thereby improving the heat exchange ability of the heat exchanger 40. Therefore, in order to increase the heat exchange ability of the heat exchanger 40, it is appropriate that the outer diameter is set in the range of 4 mm or more and 8 mm or less.

Second Embodiment

Figure 8:
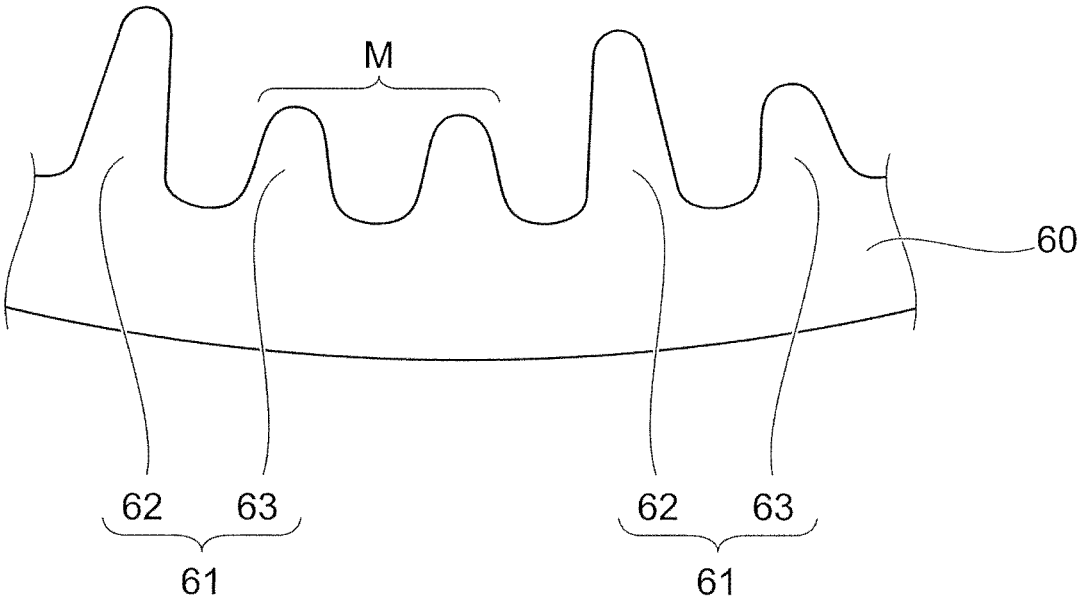
FIG. 8 is a partial cross-sectional view of a heat transfer tube of the heat exchanger for explaining the second embodiment of the present disclosure.

FIG. 8 is a partial cross-sectional view of the heat transfer tube 60 of the heat exchanger 40 for explaining the second embodiment of the present disclosure. As illustrated in the figure, the protrusions 61 are formed along the inner circumferential circle of the heat transfer tube 60, and the protrusion 61 includes the high protrusion 62 and the low protrusion 63. That is, the heat transfer tube 60 is provided with the high protrusions 62 and the low protrusions 63 formed in a spiral shape with respect to the tube axis direction. Hereinafter, the number of the low protrusions 63 formed between two of the high protrusions 62 adjacent to each other in a circumferential direction of the inner circumferential circle of the heat transfer tube 60 will be denoted by M.

When the number M of the low protrusions 63 formed between two of the adjacent high protrusions 62 in the tube circumferential direction of the inner circumferential circle of the heat transfer tube 60 is too small, the surface area of the inner surface of the heat transfer tube 60 becomes small, so that the heat transfer performance of the heat transfer tube 60 is lowered, thereby lowering the heat exchange ability of the heat exchanger 40. On the other hand, when the number M of the low protrusions 63 formed between two of the adjacent high protrusions 62 in the tube circumferential direction of the inner circumferential circle of the heat transfer tube 60 is too large, the refrigerant easily stays between the low protrusions 63, so that the heat transfer performance of the heat transfer tube 60 is lowered, thereby lowering the heat exchange ability of the heat exchanger 40. Therefore, in the second embodiment, the low protrusions 63 are formed between two of the adjacent high protrusions 62 in the tube circumferential direction of the inner circumferential circle of the heat transfer tube 60 such that the number M thereof becomes a value within a predetermined range.

Figure 9:
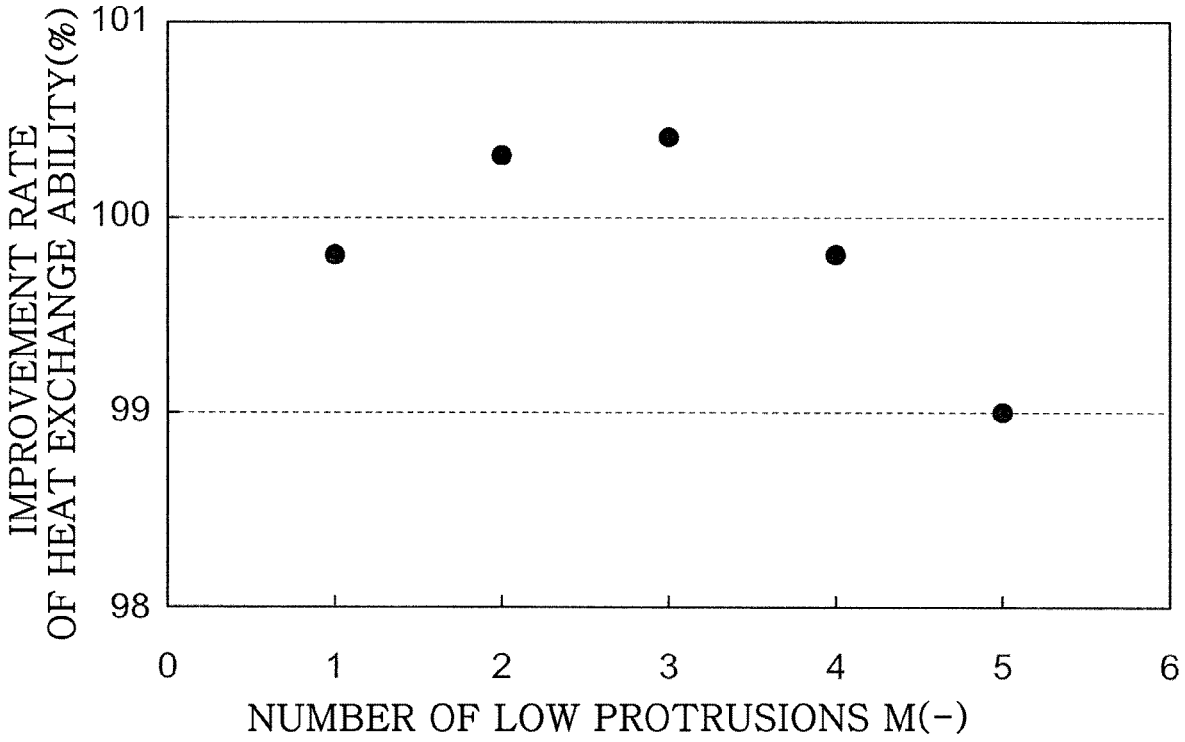
FIG. 9 is a graph illustrating the relationship between the number of low protrusions formed between two of the adjacent high protrusions on the inner circumferential circle of the heat transfer tube and the improvement rate of the heat exchange ability of the heat exchanger.

FIG. 9 is a graph illustrating the relationship between the number of the low protrusions 63 formed between two of the adjacent high protrusions 62 on the inner circumferential circle of the heat transfer tube 60 and the improvement rate of the heat exchange ability of the heat exchanger 40. Also in this graph, the heat exchange ability of the heat exchanger 40 having a general specification is indicated as 100%. As illustrated in the graph, in the range where the number M of the low protrusions 63 formed between two of the high protrusions 62 on the inner circumferential circle of the heat transfer tube 60 is 2 or more and 3 or less, a heat exchange ability improvement rate exceeds 100%. Therefore, it is appropriate that the number M of the low protrusions 63 formed between two of the high protrusions 62 on the inner circumferential circle of the heat transfer tube 60 is a value within the range between 2 or more and 3 or less.

As such, in the second embodiment, the low protrusions 63 are formed between the high protrusions 62 on the inner circumferential circle of the heat transfer tube 60 such that the number M thereof is two or three. Accordingly, because the top portion of the low protrusions 63 between the high protrusions 62 are not deformed, the heat transfer performance of the heat transfer tube 60 increases and the heat exchange ability of the heat exchanger 40 increases. On the other hand, when the low protrusions 63 are formed between the high protrusions 62 such that the number M thereof is one or less or four or more, the heat transfer performance of the heat transfer tube 60 is lowered, so that the heat exchange ability of the heat exchanger 40 is lowered. The intervals between the low protrusions 63 may be substantially even in the tube circumferential direction and may not be substantially even.

Third Embodiment

Figure 10:
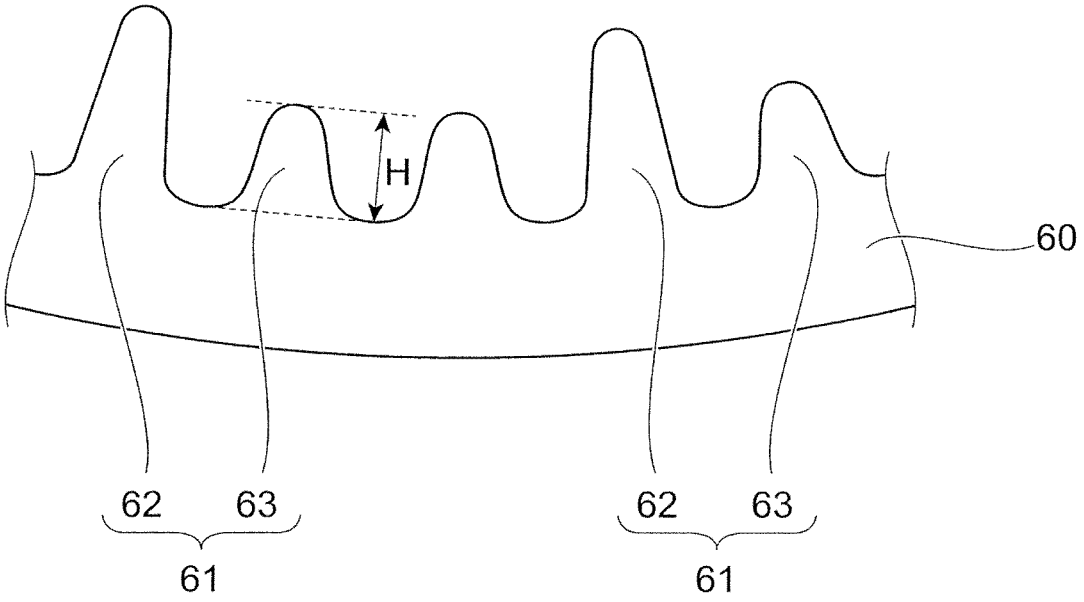
FIG. 10 is a partial cross-sectional view of a heat transfer tube of the heat exchanger for explaining the third embodiment of the present disclosure.

FIG. 10 is a partial cross-sectional view of the heat transfer tube 60 of the heat exchanger 40 for explaining the third embodiment of the present disclosure. As illustrated in the figure, the protrusions 61 are formed along the inner circumferential circle of the heat transfer tube 60, and the protrusion 61 includes the high protrusion 62 and the low protrusion 63. That is, the heat transfer tube 60 is provided with the high protrusions 62 and the low protrusions 63 formed in a spiral shape with respect to the tube axis direction. Hereinafter, a height of the low protrusion 63 on the inner circumferential circle of the heat transfer tube 60 will be denoted by H.

When a height H of the low protrusion 63 on the inner circumferential circle of the heat transfer tube 60 is too small, the surface area of the inner surface of the heat transfer tube 60 becomes small, so that the heat transfer performance of the heat transfer tube 60 is lowered, thereby lowering the heat exchange ability of the heat exchanger 40. On the other hand, when the height H of the low protrusion 63 on the inner circumferential circle of the heat transfer tube 60 is too large, the amount of the refrigerant colliding with the low protrusion 63 increases, so that the pressure loss in the tube of the heat transfer tube 60 increases, thereby lowering the heat exchange ability of the heat exchanger 40. Therefore, in the third embodiment, the low protrusion 63 on the inner circumferential circle of the heat transfer tube 60 is formed such that the height H thereof becomes a value within a predetermined range.

Figure 11:
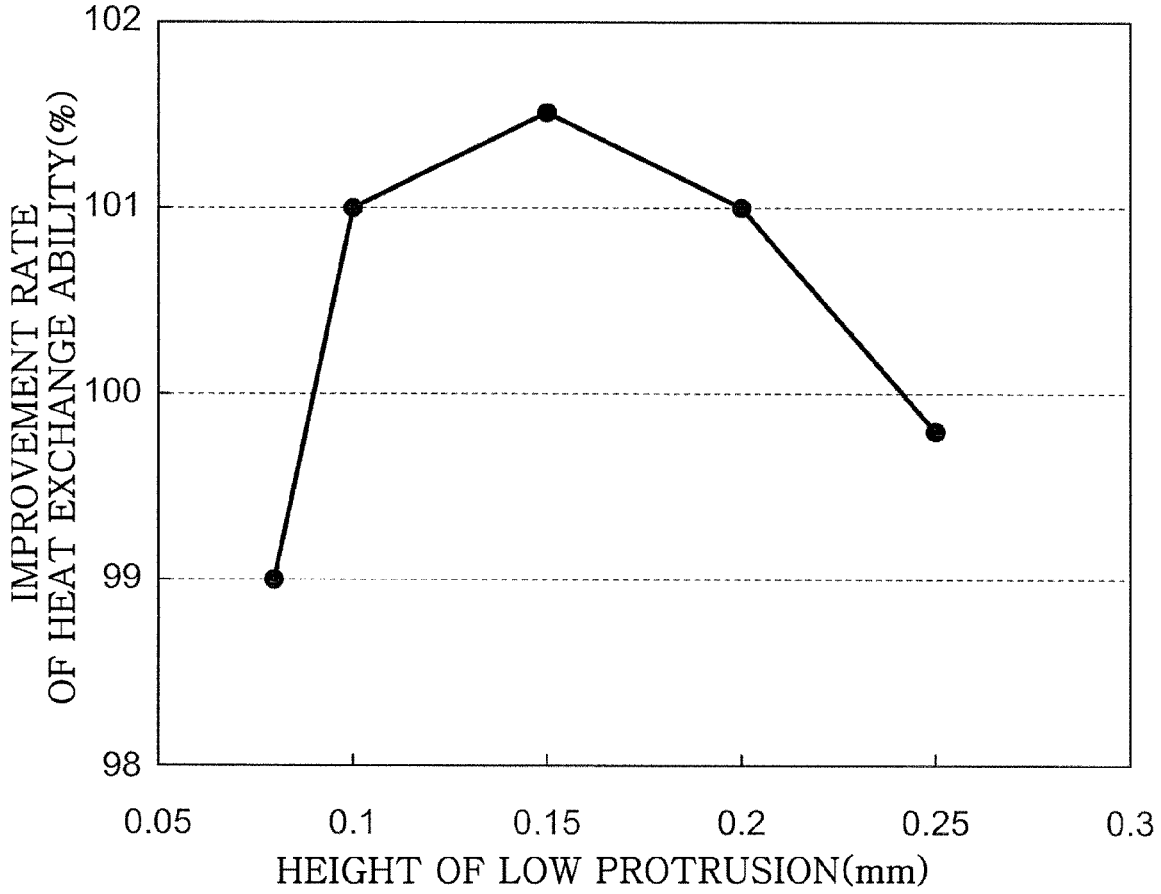
FIG. 11 is a graph illustrating the relationship between a height of the low protrusion on the inner circumferential circle of the heat transfer tube and the improvement rate of the heat exchange ability of the heat exchanger.

FIG. 11 is a graph illustrating the relationship between the height H of the low protrusion 63 on the inner circumferential circle of the heat transfer tube 60 and the improvement rate of the heat exchange ability of the heat exchanger 40. Also in this graph, the heat exchange ability of the heat exchanger 40 having a general specification is indicated as 100%. As illustrated in the graph, in the range where the height of the low protrusion 63 on the inner circumferential circle of the heat transfer tube 60 is 0.1 mm or more and 0.2 mm or less, the heat exchange ability improvement rate exceeds 100%. Therefore, it is appropriate that the height H of the low protrusion 63 on the inner circumferential circle of the heat transfer tube 60 is a value within the range between 0.1 mm or more and 0.2 mm or less.

As such, in the third embodiment, the low protrusion 63 is formed on the inner circumferential circle of the heat transfer tube 60 such that the height H thereof is a value within the range of 0.1 mm to 0.2 mm. Accordingly, the heat transfer performance of the heat transfer tube 60 increases or the pressure loss in the tube of the heat transfer tube 60 decreases, thereby improving the heat exchange ability of the heat exchanger 40. When the height H of the low protrusion 63 on the inner circumferential circle of the heat transfer tube 60 becomes 0.08 mm or less, the heat transfer performance of the heat transfer tube 60 is lowered, thereby lowering the heat exchange ability of the heat exchanger 40. On the other hand, when the height H of the low protrusion 63 on the inner circumferential circle of the heat transfer tube 60 becomes 0.25 mm or more, the pressure loss in the tube of the heat transfer tube 60 increases, thereby lowering the heat exchange ability of the heat exchanger 40.

Fourth Embodiment

Figure 12:
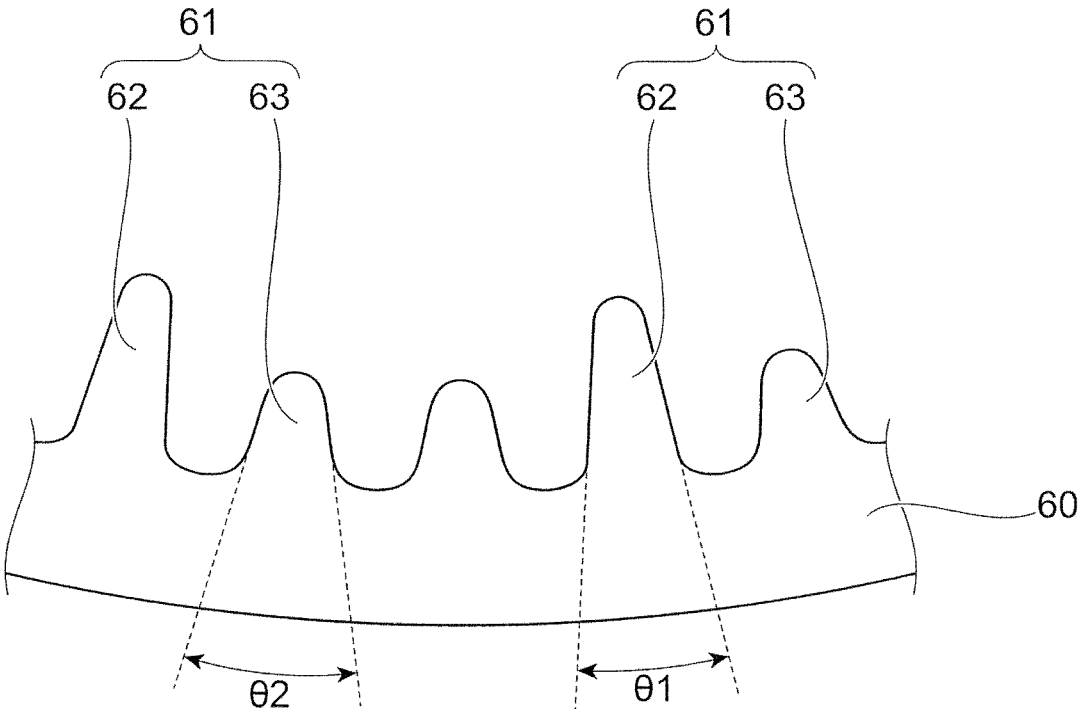
FIG. 12 is a partial cross-sectional view of a heat transfer tube of the heat exchanger for explaining a fourth embodiment of the present disclosure.

FIG. 12 is a partial cross-sectional view of the heat transfer tube 60 of the heat exchanger 40 for explaining a fourth embodiment of the present disclosure. As illustrated in the figure, the protrusions 61 are formed along the inner circumferential circle of the heat transfer tube 60, and the protrusion 61 includes the high protrusion 62 and the low protrusion 63. That is, the heat transfer tube 60 is provided with the high protrusions 62 and the low protrusions 63 formed in a spiral shape with respect to the tube axis direction. Hereinafter, a vertex angle of the high protrusion 62 will be noted by θ1, and a vertex angle of the low protrusion 63 will be noted by θ2.

When a vertex angle θ1 of the high protrusion 62 on the inner circumferential circle of the heat transfer tube 60 is too small, the top portion thereof is greatly deformed by the contact with the expander at the time of tube expansion, so that the close contact between the heat transfer tube 60 and the fins 50 is lowered, thereby lowering the heat exchange ability of the heat exchanger 40. On the other hand, when the vertex angle θ1 of the high protrusion 62 on the inner circumferential circle of the heat transfer tube 60 is too large, the refrigerant easily stays between the high protrusion 62 and the adjacent low protrusions 63, so that the heat transfer performance of the heat transfer tube 60 is lowered, thereby lowering the heat exchange ability of the heat exchanger 40. Therefore, in the fourth embodiment, the high protrusion 62 is formed on the inner circumferential circle of the heat transfer tube 60 such that the vertex angle θ1 thereof is a value within a predetermined range.

When a vertex angle θ2 of the low protrusion 63 on the inner circumferential circle of the heat transfer tube 60 is too large, a width of a portion close to the inner circumferential circle becomes large, so that the heat transfer performance of the heat transfer tube 60 is lowered, thereby lowering the heat exchange ability of the heat exchanger 40. On the other hand, when the vertex angle θ2 of the low protrusion 63 on the inner circumferential circle of the heat transfer tube 60 is too small, it leads to the limitation of production and the mass productivity is lowered, which increases the production cost. Therefore, in the fourth embodiment, the low protrusion 63 is formed on the inner circumferential circle of the heat transfer tube 60 such that its vertex angle θ2 is a value within a predetermined range.

Because the expander is in contact with the high protrusion 62 on the inner circumferential circle of the heat transfer tube 60 in the manufacture of the heat exchanger 40 and widens the heat transfer tube 60, in order to reduce the deformation of the top portion of the high protrusion 62, it is appropriate that the shape of the top portion of the high protrusion 62 is trapezoidal. However, the shape may be trapezoid-like, that is, substantially trapezoidal, rather than a perfect trapezoid. The shape of the top portion of the low protrusion 63 may be circular. However, this shape may also not be a perfect circle, but may be a shape close to a circle, that is, a substantially circle.

Figure 13:
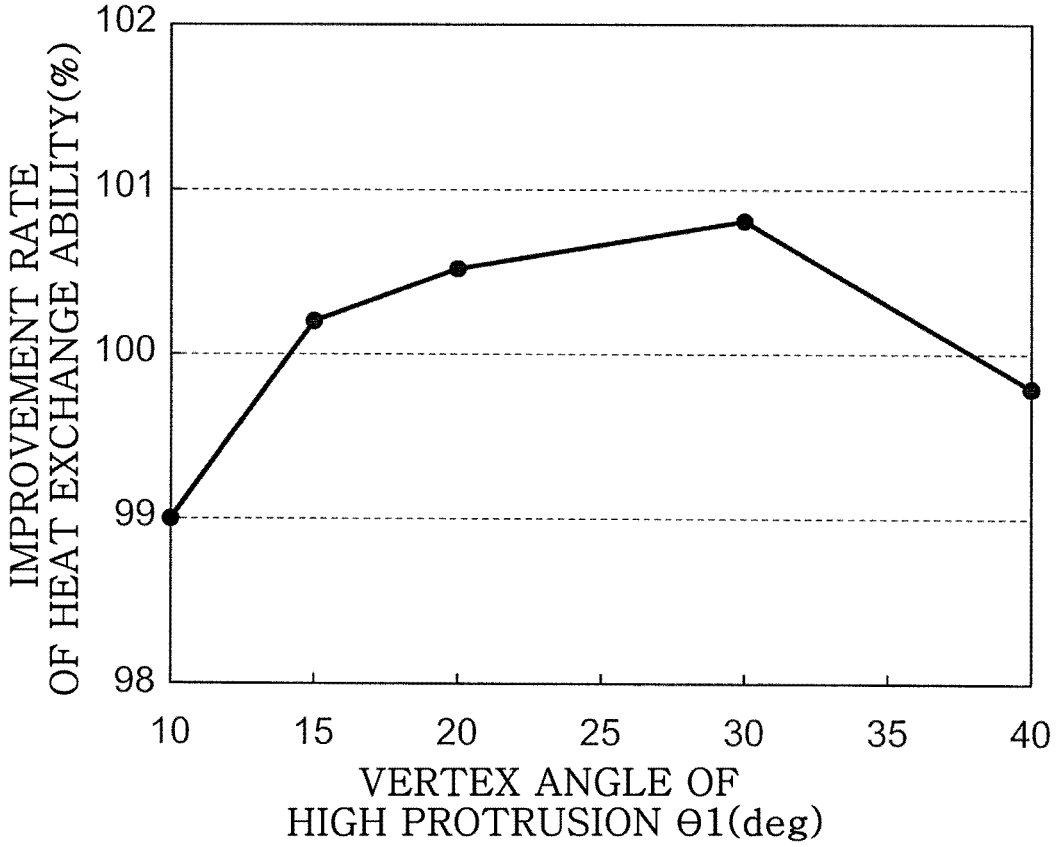
FIG. 13 is a graph illustrating the relationship between a vertex angle of the high protrusion on the inner circumferential circle of the heat transfer tube and the improvement rate of the heat exchange ability of the heat exchanger.

FIG. 13 is a graph illustrating the relationship between the vertex angle θ1 of the high protrusion 62 on the inner circumferential circle of the heat transfer tube 60 and the improvement rate of the heat exchange ability of the heat exchanger 40. Also in this graph, the heat exchange ability of the heat exchanger 40 having a general specification is indicated as 100%. As illustrated in the graph, in the range where the vertex angle θ1 of the high protrusion 62 on the inner circumferential circle of the heat transfer tube 60 is 15 degrees or more and 30 degrees or less, the heat exchange ability improvement rate exceeds 100%. Therefore, it is appropriate that the vertex angle θ1 of the high protrusion 62 on the inner circumferential circle of the heat transfer tube 60 is a value within the range between 15 degrees or more and 30 degrees or less.

Figure 14:
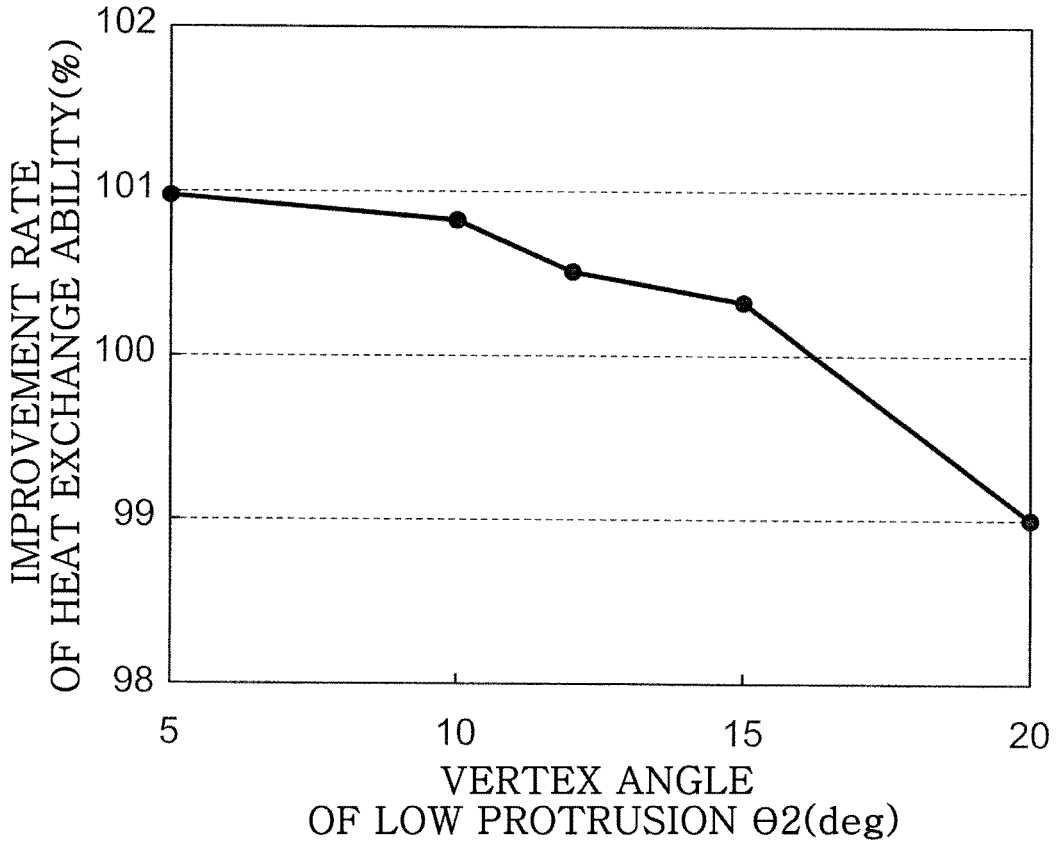
FIG. 14 is a graph illustrating the relationship between a vertex angle of the low protrusion on the inner circumferential circle of the heat transfer tube and the improvement rate of the heat exchange ability of the heat exchanger.

FIG. 14 is a graph illustrating the relationship between the vertex angle θ2 of the low protrusion 63 on the inner circumferential circle of the heat transfer tube 60 and the improvement rate of the heat exchange ability of the heat exchanger 40. Also in this graph, the heat exchange ability of the heat exchanger 40 having a general specification is indicated as 100%. As illustrated in the graph, in the range where the vertex angle θ2 of the low protrusion 63 on the inner circumferential circle of the heat transfer tube 60 is 5 degrees or more and 15 degrees or less, the heat exchange ability improvement rate exceeds 100%. However, when the vertex angle θ2 of the low protrusion 63 on the inner circumferential circle of the heat transfer tube 60 is smaller than 10 degrees, it leads to the limitation of production and the mass productivity is lowered, which increases the production cost. Therefore, it is appropriate that the vertex angle θ2 of the low protrusion 63 on the inner circumferential circle of the heat transfer tube 60 is a value within the range between 10 degrees or more and 15 degrees or less.

As such, in the fourth embodiment, the high protrusion 62 is formed on the inner circumferential circle of the heat transfer tube 60 such that the vertex angle θ1 thereof is in the range of 15 degrees to 30 degrees. Accordingly, the heat transfer performance of the heat transfer tube 60 increases, thereby increasing the heat exchange ability of the heat exchanger 40. When the vertex angle θ1 of the high protrusion 62 on the inner circumferential circle of the heat transfer tube 60 is 10 degrees or less, the top portion thereof is greatly deformed by the contact with the expander at the time of tube expansion and the close contact between the heat transfer tube 60 and the fins 50 is lowered, thereby lowering the heat exchange ability of the heat exchanger 40. On the other hand, when the vertex angle θ1 of the high protrusion 62 on the inner circumferential circle of the heat transfer tube 60 is 40 degrees or more, the heat transfer performance of the heat transfer tube 60 is lowered, thereby lowering the heat exchange ability of the heat exchanger 40. In addition, the top portion of the high protrusion 62 on the inner circumferential circle of the heat transfer tube 60 is formed in a trapezoidal shape, so that deformation of the top portion of the high protrusion 62 becomes small even by the contact with the expander at the time of tube expansion.

In the fourth embodiment, the low protrusion 63 is formed on the inner circumferential circle of the heat transfer tube 60 so that the vertex angle θ2 thereof is a value within the range of 10 degrees to 15 degrees. Accordingly, in a range where the production is not limited, the heat transfer performance of the heat transfer tube 60 increases, thereby increasing the heat exchange ability of the heat exchanger 40. When the vertex angle θ2 of the low protrusion 63 on the inner circumferential circle of the heat transfer tube 60 is 20 degrees or more, the heat transfer performance of the heat transfer tube 60 is lowered, thereby lowering the heat exchange ability of the heat exchanger 40. On the other hand, when the vertex angle θ2 of the low protrusion 63 on the inner circumferential circle of the heat transfer tube 60 is 5 degrees or less, it leads to the limitation of production and the mass productivity is lowered, which increases the production cost.

The invention claimed is:

1. An air conditioner comprising:

a pipe configured to allow a refrigerant to flow;

an outdoor unit comprising an outdoor heat exchanger configured to cause heat exchange between the refrigerant moving along the pipe and outdoor air; and an indoor unit comprising an indoor heat exchanger configured to cause heat exchange between the refrigerant moving along the pipe and indoor air, wherein at least one of the outdoor heat exchanger and the indoor heat exchanger comprises:

a heat transfer tube configured to allow the refrigerant to flow; and fins installed on the heat transfer tube to widen a heat transfer area of the heat transfer tube, each fin comprising a fin collar extending therefrom in an axial direction of the heat transfer tube, the fin collars collectively forming an insertion hole through which the heat transfer tube is inserted and passes, the fin collars being in contact with the heat transfer tube by tube expansion of the heat transfer tube, and wherein the heat transfer tube comprises:

high protrusions disposed in a spiral shape with respect to a tube axis direction of the heat transfer tube, twenty one to twenty seven of the high protrusions being formed along a circumferential direction of the heat transfer tube; and low protrusions disposed between two adjacent high protrusions along the circumferential direction of the heat transfer tube and having a height lower by 0.03 mm to 0.05 mm than the high protrusions.

2. The air conditioner according to claim 1, wherein a width of a top portion of each of the high protrusions is larger than a width of a top portion of each of the low protrusions.

3. The air conditioner according to claim 1, wherein two or three of the low protrusions are formed between the two adjacent high protrusions along the circumferential direction of the heat transfer tube.

4. The air conditioner according to claim 1, wherein a height of each of the low protrusions is in a range of 0.1 mm to 0.2 mm.

5. The air conditioner according to claim 1, wherein each of the high protrusions is formed such that a vertex angle thereof is in a range of 15 degrees to 30 degrees.

6. The air conditioner according to claim 1, wherein each of the low protrusions is formed such that a vertex angle thereof is in a range of 10 degrees to 15 degrees.

7. The air conditioner according to claim 1, wherein each of the high protrusions is formed such that a shape of a top portion thereof is substantially trapezoidal.

8. The air conditioner according to claim 1, wherein each of the low protrusions is formed such that a shape of a top portion thereof is substantially circular.

9. A heat exchanger comprising:

a heat transfer tube configured to allow a refrigerant to flow; and fins installed on the heat transfer tube to widen a heat transfer area of the heat transfer tube, each fin comprising a fin collar extending therefrom in an axial direction of the heat transfer tube, the fin collars collectively forming an insertion hole through which the heat transfer tube is inserted and passes, the fin collars being in contact with the heat transfer tube by tube expansion of the heat transfer tube, wherein the heat transfer tube comprises:

high protrusions disposed in a spiral shape with respect to a tube axis direction of the heat transfer tube, twenty one to twenty seven of the high protrusions being formed along a circumferential direction of the heat transfer tube; and low protrusions disposed between two adjacent high protrusions along the circumferential direction of the heat transfer tube and having a height lower by 0.03 mm to 0.05 mm than the high protrusions.

10. The heat exchanger according to claim 9, wherein a width of a top portion of each of the high protrusions is larger than a width of a top portion of each of the low protrusions.

11. The heat exchanger according to claim 9, wherein two or three of the low protrusions are formed between the two adjacent high protrusions along the circumferential direction of the heat transfer tube.

12. The heat exchanger according to claim 9, wherein a height of each of the low protrusions is in a range of 0.1 mm to 0.2 mm.

13. The heat exchanger according to claim 9, wherein each of the high protrusions is formed such that a vertex angle thereof is in a range of 15 degrees to 30 degrees.

14. The heat exchanger according to claim 9, wherein each of the low protrusions is formed such that a vertex angle thereof is in a range of 10 degrees to 15 degrees.

15. The heat exchanger according to claim 9, wherein each of the high protrusions is formed such that a shape of a top portion thereof is substantially trapezoidal, and each of the low protrusions is formed such that a shape of a top portion thereof is substantially circular.

* * * * *